US011084150B2

(12) United States Patent
Freeman et al.

(10) Patent No.: US 11,084,150 B2
(45) Date of Patent: Aug. 10, 2021

(54) WEAR LINER INSTALLATION TOOL

(71) Applicant: United Technologies Corporation, Farmington, CT (US)

(72) Inventors: Thomas Freeman, Kennebunk, ME (US); Colin G. Amadon, Kennebunk, ME (US)

(73) Assignee: Raytheon Technologies Corporation, Farmington, CT (US)

( * ) Notice: Subject to any disclaimer, the term of this patent is extended or adjusted under 35 U.S.C. 154(b) by 336 days.

(21) Appl. No.: 15/884,879

(22) Filed: Jan. 31, 2018

(65) Prior Publication Data

US 2019/0232472 A1 Aug. 1, 2019

(51) Int. Cl.

| | |
|---|---|
| ***B25B 27/00*** | (2006.01) |
| ***F01D 25/24*** | (2006.01) |
| ***F01D 25/28*** | (2006.01) |
| *F01D 11/00* | (2006.01) |
| *F01D 9/04* | (2006.01) |

(52) U.S. Cl.

CPC ..... *B25B 27/0092* (2013.01); *F01D 25/285* (2013.01); *F01D 9/042* (2013.01); *F01D 11/005* (2013.01); *F01D 25/24* (2013.01); *F01D 25/246* (2013.01); *F05D 2220/32* (2013.01); *F05D 2220/36* (2013.01); *F05D 2230/60* (2013.01); *F05D 2240/11* (2013.01); *F05D 2240/57* (2013.01)

(58) Field of Classification Search

CPC . B25B 27/0092; F01D 25/285; F01D 25/246; F01D 11/005; F01D 25/24; F01D 9/04; F05D 2230/60; F05D 2220/36; F05D 2240/11; F05D 2240/57; F05D 2220/32; Y10T 29/53657; F04D 29/542; F04D 29/668; F04D 29/541; F04D 29/083

USPC ..... 29/235

See application file for complete search history.

(56) References Cited

U.S. PATENT DOCUMENTS

| | | | | |
|---|---|---|---|---|
| 1,496,239 A | | 6/1924 | Lynch | |
| 2,533,367 A | * | 12/1950 | Gruszecki | B25B 27/0092 29/270 |
| 3,550,242 A | * | 12/1970 | Dallen | E04F 21/0038 29/235 |
| 5,153,974 A | * | 10/1992 | Follens | B25B 27/0092 29/235 |

(Continued)

FOREIGN PATENT DOCUMENTS

| | | |
|---|---|---|
| EP | 2930311 A1 | 10/2015 |
| EP | 3244017 A2 | 11/2017 |

OTHER PUBLICATIONS

Extended European Search Report for EP Application No. 18209660.2, dated Jun. 3, 2019, 6 pages.

*Primary Examiner* — Lee D Wilson
*Assistant Examiner* — Mahdi H Nejad
(74) *Attorney, Agent, or Firm* — Kinney & Lange, P.A.

(57) ABSTRACT

A tool for seating a wear liner into a first groove of a fan case of a gas turbine engine includes a body, a handle, and a first guide foot. The body includes a first end and a second end. The handle is connected to and extends from the body. The first guide foot is connected to and extends from the first end of the body. The first guide foot includes a first end connected to the body and a second end opposite from the first end of the first guide foot. The second end of the first guide foot is rounded and includes a chamfered portion.

7 Claims, 6 Drawing Sheets

(56) References Cited

U.S. PATENT DOCUMENTS

| | | | | |
|---|---|---|---|---|
| 5,211,506 | A * | 5/1993 | Manion | E01C 23/0986 404/87 |
| 9,353,649 | B2 | 5/2016 | Rioux | |
| 9,796,055 | B2 * | 10/2017 | Anderson | B23P 6/007 |
| 10,316,861 | B2 * | 6/2019 | Freeman | F04D 29/083 |
| 2010/0068050 | A1 * | 3/2010 | Hansen | F01D 9/042 415/209.3 |
| 2012/0076659 | A1 * | 3/2012 | Robertson | B01D 46/02 416/219 R |
| 2014/0093363 | A1 * | 4/2014 | Ring | F01D 9/042 415/189 |
| 2014/0241874 | A1 * | 8/2014 | Rioux | F01D 25/246 415/209.4 |
| 2017/0145841 | A1 * | 5/2017 | Congratel | F01D 9/042 |
| 2017/0306791 | A1 * | 10/2017 | Biolsi | F01D 25/007 |

* cited by examiner

WEAR LINER INSTALLATION TOOL

STATEMENT OF GOVERNMENT INTEREST

This invention was made with government support under FA8626-15-D-0015-3501 awarded by United States Air Force. The government has certain rights in the invention.

BACKGROUND

The present disclosure relates to installation of a wear liner. More particularly, the present disclosure relates to a tool for installing a wear liner into a groove of a fan case.

The operating environment for gas turbine engines is extremely harsh. Vibrations due to normal use at operating speeds are extreme. Additionally, the operating temperature experienced by some engine components is extremely high. The feet of vanes are among the many components that experience wear in the engine due to vibrations and high temperature. Wear liners are used in grooves of the fan case between the vane feet and an engine case in order to reduce wear.

If the wear liner is not placed into the groove perfectly straight, then the wear liner can get stuck at a slight diagonal preventing the wear liner from being fully seated within the groove. This prohibits the installation of the stators into the fan case. Existing methods used by mechanics, to force the wear liner to fully seat within the groove, such as using large amounts of blunt force with a hammer, risk causing damage to and failure of the wear liner.

SUMMARY

A tool for seating a wear liner into a first groove of a fan case of a gas turbine engine includes a body, a handle, and a first guide foot. The body includes a first end and a second end. The handle is connected to and extends from the body. The first guide foot is connected to and extends from the first end of the body. The first guide foot includes a first end connected to the body and a second end opposite from the first end of the first guide foot. The second end of the first guide foot is rounded and includes a chamfered portion.

A method of installing a liner into a first groove of a fan case of a gas turbine engine includes aligning a portion of the liner with the first groove of the fan case. A portion of the liner is inserted into the first groove of the fan case. A first guide foot of a tool is inserted into the first groove of the fan case such that a portion of the liner is disposed between the first guide foot and a surface of the first groove of the fan case. The tool is moved in a circumferential direction relative to the fan case. The first guide foot of the tool is engaged with the liner such that the first guide foot pulls the liner into the first groove The liner is seated into the first groove such that the liner is fully seated into the first groove.

DETAILED DESCRIPTION

Figure 1:
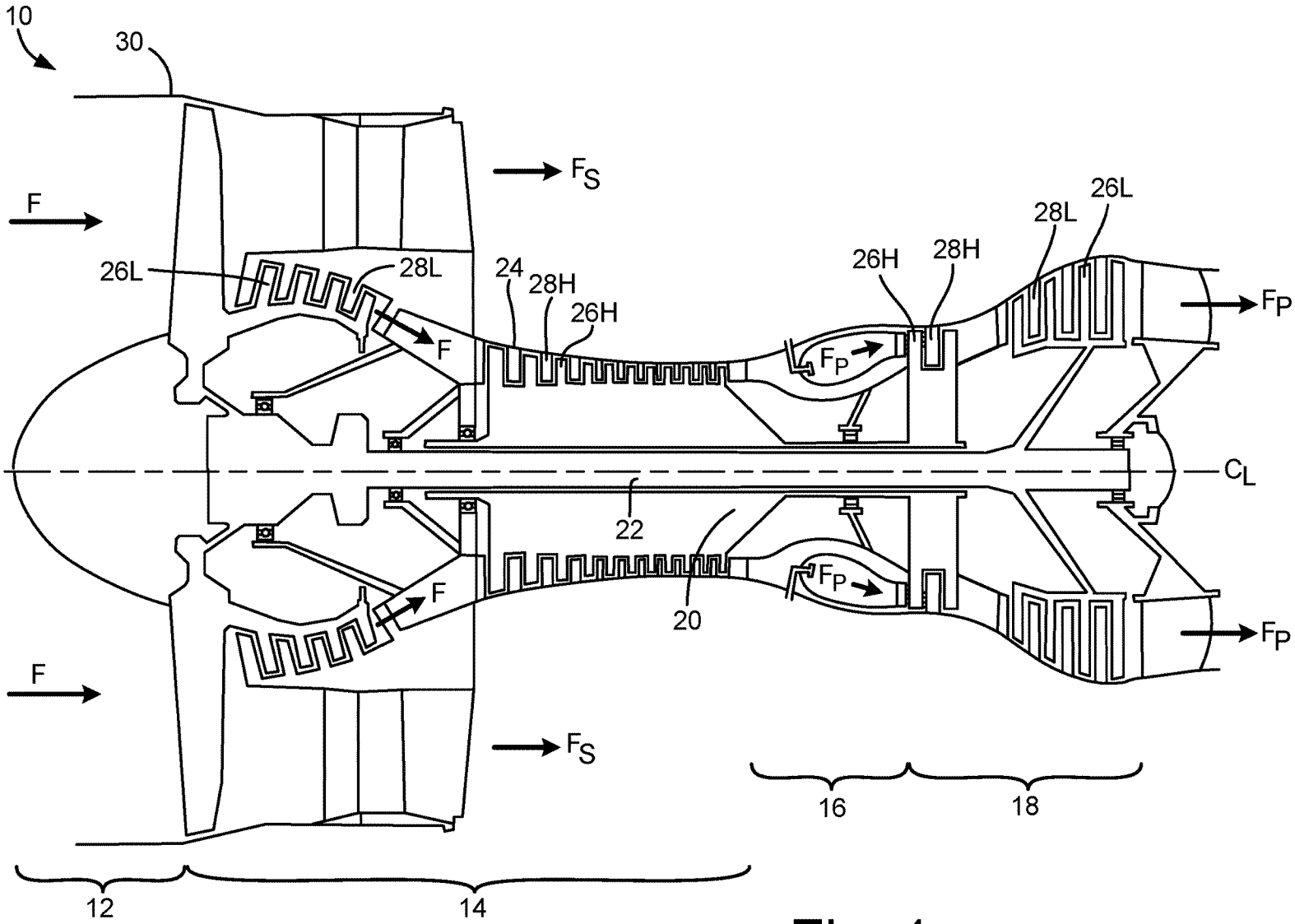
FIG. 1 is a cross-section view of a gas turbine engine.

FIG. 1 is a cross-section view of gas turbine engine 10 including a liner/vane assembly of the present disclosure. The view in FIG. 1 is a longitudinal sectional view along engine centerline $C_L$. FIG. 1 shows gas turbine engine 10 including fan section 12, compressor section 14, combustor section 16, turbine section 18, high pressure rotor 20, low pressure rotor 22, engine case 24, rotor stages 26, stator stages 28, and fan case 30. Compressor section 14 includes low pressure rotor stages 26L, high pressure rotor stages 26H, low pressure stator stages 28L, and high pressure stator stages 28H. Turbine section 18 includes high pressure rotor stages 26H, low pressure rotor stages 26L, high pressure stator stages 28H, and low pressure stator stages 28L.

As illustrated in FIG. 1, fan section 12 extends from engine centerline $C_L$ near a forward end of gas turbine engine 10. Compressor section 14 is disposed aft of fan section 12 along engine centerline $C_L$, followed by combustor section 16. Turbine section 18 is located adjacent combustor section 16, opposite compressor section 14. High pressure rotor 20 and low pressure rotor 22 are mounted for rotation about engine centerline $C_L$. High pressure rotor 20 connects a high pressure section of turbine section 18 to a high pressure section of compressor section 14. Low pressure rotor 22 connects a low pressure section of turbine section 18 to fan section 12 and a low pressure section of compressor section 14. Engine case 24 surrounds gas turbine engine 10 providing structural support for compressor section 14, combustor section 16, and turbine section 18, as well as containment for air flow through engine 10. Rotor stages 26 and stator stages 28 are arranged throughout compressor section 14 and turbine section 18 in alternating rows. High pressure rotor stages 26H connect to high pressure rotor 20 and low pressure rotor stages 26L connect to low pressure rotor 22. Fan case 30 is a portion of engine case 24 that surrounds fan section 12.

In operation, air flow F enters compressor section 14 after passing between fan blades 12. Air flow F is compressed by the rotation of compressor section 14 driven by high pressure turbine section 18. The compressed air from compressor section 14 is divided, with a portion going to combustor section 16, a portion bypasses through fan 12, and a portion employed for cooling components, buffering, and other purposes. Compressed air and fuel are mixed and ignited in combustor section 16 to produce high-temperature, high pressure combustion gases $F_P$. Combustion gases $F_P$ exit combustor section 16 into turbine section 18.

Low pressure stator stages 28L and high pressure stator stages 28H properly align the flow of air flow F and combustion gases $F_P$ for an efficient attack angle on subsequent low pressure rotor stages 26L and high pressure rotor stages 26H, respectively. The flow of combustion gases $F_P$ past low pressure rotor stages 26L of turbine section 18 drives rotation of low pressure rotor 22 (which drives fan blades 12 to produce thrust $F_S$ from gas turbine engine 10) and low pressure compressor stages 26L. High pressure rotor stages 26H of turbine section drive high pressure rotor 20, which drives high pressure rotor stages 26H of compressor section 14.

Although embodiments of the present disclosure are illustrated for a turbofan gas turbine engine for aviation use, it is understood that the present disclosure applies to other aviation gas turbine engines and to industrial gas turbine engines as well.

Figure 2B:
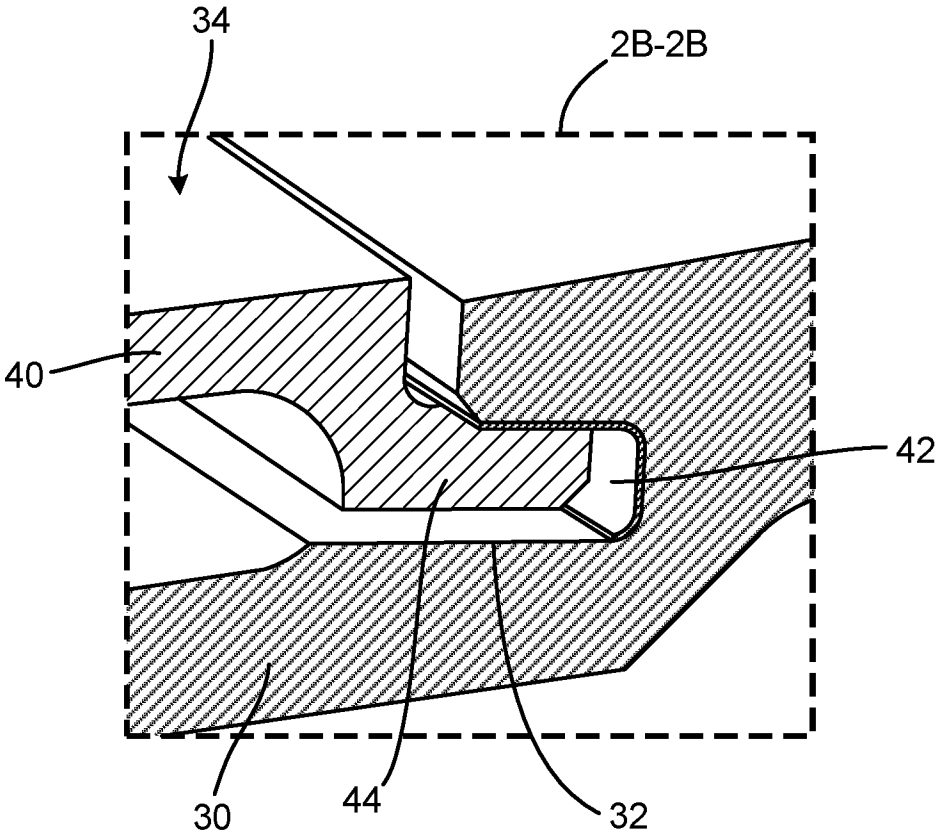
FIG. 2B is an enlarged perspective view of a portion of the fan case with a J-groove, the stator, and the wear liner.
Figure 2A:
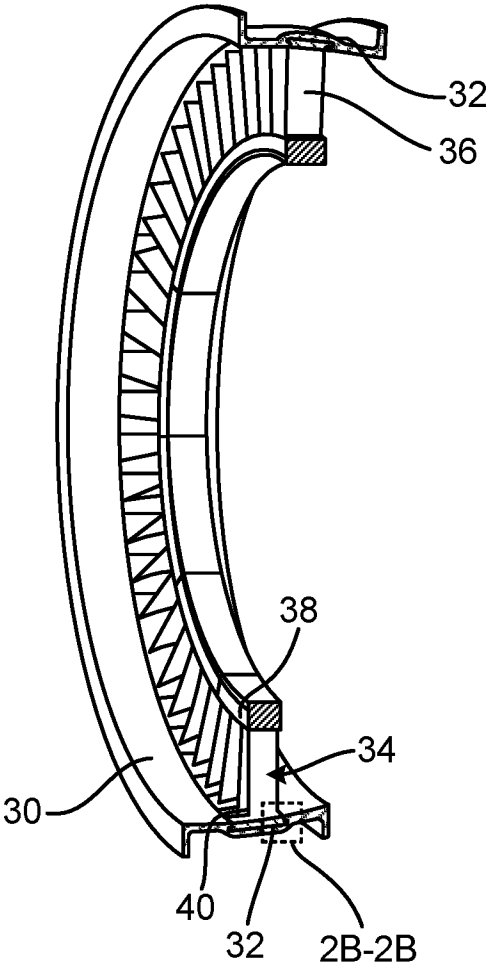
FIG. 2A is a perspective view of a portion of a fan case with stators and a wear liner.

FIG. 2A is a perspective view of a portion of fan case 30 and shows fan case 30 (with J-groove 32), vanes 34 (with airfoils 36, inner platforms 38, and outer platforms 40), and wear liner 42. FIG. 2B is an enlarged perspective view of section 2-2 of FIG. 2A and shows fan case 30 (with J-groove 32), vane 34 (with outer platform 40 (including aft foot 44)), and wear liner 42. FIGS. 2A and 2B include the same or similar elements and will be discussed in unison.

In this non-limiting embodiment, fan case 30 is a one half of a full circumference of a fan case for gas turbine engine 10. J-groove 32 is a slot or groove extending circumferentially within fan case 30. Vanes 34 are stator vanes configured to manipulate a stream of air flowing across vanes 34. Airfoils 36 are the airfoil portions of vanes 34. Inner platforms 38 and outer platforms 40 are opposite ends of vanes 34 that are configured for attachment to a case such as fan case 30. Wear liner 42 is a liner configured to prevent abrasion or wear between two articles. Aft foot 44 is an engagement feature for mounting vanes 34 to fan case 30.

Fan case 30 surrounds a portion of gas turbine engine 10. J-groove 32 is disposed along a radially inner surface of fan case 30 and extends along the circumference of fan case 30 (which in the case of fan case 30 extends 180 degrees). J-groove 32 receives outer platforms 38 of vanes 34. Vanes 34 are mounted to fan case 30 via engagement of outer platforms 38 with J-groove 32. Airfoils 36 are connected to and extend between inner platforms 38 and outer platforms 40. Inner platforms 38 are connected to radially inward ends of airfoils 36. Outer platforms 40 are connected to radially outward ends of airfoils 36. Wear liner 42 is seated within J-groove 32 and is disposed between aft foot 44 of outer platform 38 and a surface (or surfaces) of J-groove 32. Aft foot 44 is disposed in J-groove 32 and is in contact with wear liner 42.

Fan case 30 provides a housing for and containment of fan portion 12 of gas turbine engine 10. J-groove 32 receives aft feet 44 of vanes 34 so as to mount vanes 34 to fan case 30. J-groove 32 is configured to receive wear liner 42 and hold wear liner 42 between portions of aft feet 44 and surfaces of fan case 30 that form J-groove 32. Airfoils 36 of vanes 34 are configured as airfoils to guide and disrupt a flow of air across vanes 34 so as to direct the flow of air in manner beneficial for the operation of gas turbine engine 10. Inner platforms 38 function to support airfoils 36 of vanes 34 and provide additional mounting features for vanes 34. Outer platforms 40 are adapted with aft feet 44 that are disposed within J-groove 32 of fan case 30 to allow vanes 34 to be supported therefrom. Wear liner 42 dampens vibration between vanes 34 and fan case 30, accommodates thermal growth between outer platforms 40 and fan case 30, and allows for ease of assembly and disassembly of vanes 34 into and out of J-groove 32.

Figure 3A:
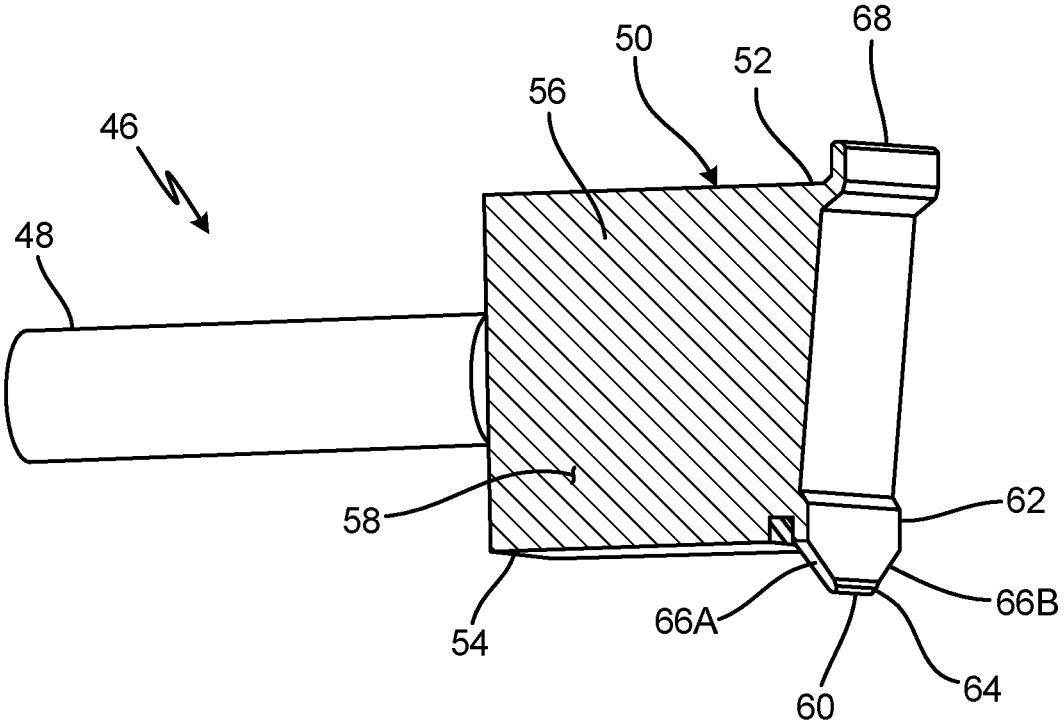
FIG. 3A is a perspective view of a tool for installing the wear liner into the J-groove of the fan case.
Figure 3B:
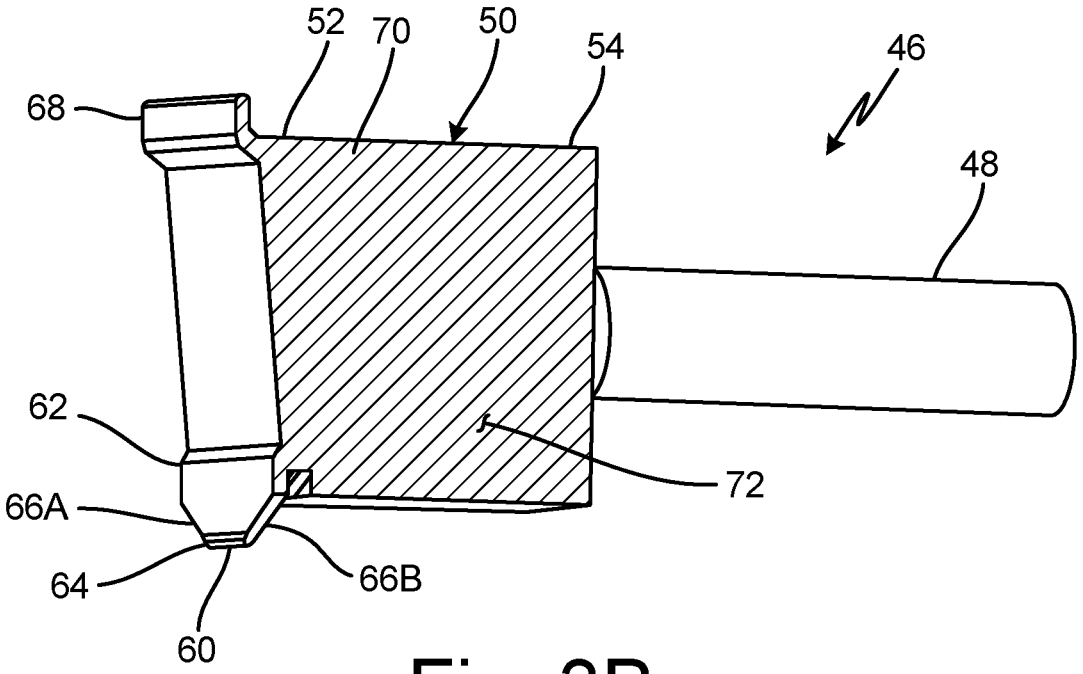
FIG. 3B is another perspective view of the tool from an alternate angle as shown in FIG. 3A.

FIG. 3A is a perspective view of tool 46 for installing wear liner 42 into J-groove 32 of fan case 30 and shows tool 46 with handle 48, body 50 (with first end 52, second end 54, first side 56 (including first face 58)), first guide foot 60 (with first end 62 and second end 64 (including first chamfer 66A and second chamfer 66B)), and second guide foot 68. FIG. 3B is a perspective view of tool 46 (from an alternate angle as shown in FIG. 3A) and shows tool 46 with handle 48, body 50 (with first end 52, second end 54, second side 70 (including second face 72)), first guide foot 60 (with first end 62 and second end 64 (including first chamfer 66A and second chamfer 66B)), and second guide foot 68. FIGS. 3A and 3B include the same or similar elements and will be discussed in unison.

Tool 46 is a wear liner installation tool. In one non-limiting embodiment, tool 46 can be formed by stereolithography and/or a material of tool 46 and its components can include a thermoplastic such as polyoxymethylene. Handle 48 is an elongated cylinder or a longitudinal shaft of solid material. Body 50 is a main portion of tool 46. In this non-limiting embodiment, body 50 is in the shape of a rectangular cuboid. In other non-limiting embodiments, body 50 can include other geometric shapes such as a polyhedron. First end 52 and second end 54 are opposite ends of body 50. First side 56 and second side 70 are opposite sides of body 50. First face 58 and second face 72 are flat, planar surfaces of body 50. First guide foot 60 and second guide foot 68 are planar protrusions of solid material. First end 62 and second end 64 are opposite ends of first guide foot 60. First chamfer 66A and second chamfer 66B are slanted or sloped surfaces of first guide foot 60. In one non-limiting embodiment, the surfaces of first and/or second chamfers 66A and 66B can be flat, planar surfaces. In other non-limiting embodiments, the surfaces of first and/or second chamfers 66A and 66B can be rounded to match a rounded shape of a portion of wear liner 42 or to match a rounded shape of the edge of second end 64 of first guide foot 60. In another non-limiting embodiment, second guide foot 68 can include at least one chamfer similar to first guide foot 60.

During use, tool 46 is inserted into a portion of J-groove 32 and in to contact with wear liner 42. Handle 48 is connected to and extends from second end 54 of body 50. Body 50 is connected to handle 48, first guide foot 60, and second guide foot 68. First end 52 and second end 54 are disposed on opposite surfaces of body 50 from each other. First end 52 and second end 54 are disposed on longitudinal ends of body 50. First side 56 and second side 70 are disposed on opposite surfaces of body 50 from each other. First side 56 and second side 70 form first face 58 and second face 72 of body 50. First face 58 and second face 72 are disposed on first side 56 and second side 58, respectively of body 50. First face 58 and second face 72 form major faces of body 50. In one non-limiting embodiment, first face 58 and second face 72 are generally (and approximately) orthogonal to a tangent line of guide foot 60.

First guide foot 60 and second guide foot 68 are attached to or formed with first end 52 of body 50. First end 62 of first guide foot 60 is connected to first end 52 of body 50. Second end 64 of first guide foot 60 extends in an opposite direction from first end 62. First chamfer 66A and second chamfer 66B form sloped surfaces on portions of second end 64 of first guide foot 60.

Tool 46 is used to install wear liner 42 into J-groove 32 such that wear liner 42 becomes fully seated into J-groove 32. In one non-limiting embodiment, tool 46 can be used to effectuate a complete installation of wear liner 42 into J-groove 32 by using tool 46 to cause wear liner 42 to enter J-groove 32 and drawing wear liner 42 all the way into a fully seated position within J-groove 32. In another non-limiting embodiment, tool 46 can be used at a point during installation if wear liner 42 becomes stuck or jammed in J-groove 32. If wear liner 42 becomes stuck in J-groove 32 during insertion of wear liner 42 into J-groove 32, tool 46 can be employed to dislodge wear liner 42 at the location where wear liner 42 is stuck so as to allow wear liner 42 to move within J-groove 32 (i.e., such that wear liner 42 becomes un-stuck), thereby allowing wear liner 42 to become fully seated within J-groove 32.

Handle 48 provides a user of tool 46 a grip to hold onto as the user moves tool 46 along the circumference of fan case 30. Body 50 holds all of the components of tool 46 together. First face 58 and second face 72 provides surfaces onto which the user can apply a force to body 50 in a tangential direction relative to case 30 so as to cause wear liner 42 to progress along J-groove 32. In one non-limiting embodiment, the user can apply a force in a circumferential direction (i.e., not straight down onto wear liner 42) with another tool (e.g., a hammer) onto to one of first or second faces 58 or 72 so as to nudge tool 46 in the circumferential direction along fan case 30. First guide foot 60 is used to pull wear liner 42 into J-groove 32 as tool 46 is moved in a circumferential direction relative to fan case 30.

As tool 46 is moved in a circumferential direction relative to fan case 30, first chamfer 66A engages with wear liner 42 such that first guide foot 60 pulls wear liner 42 into J-groove 32. First chamfer 66A is drawn in to contact with and across wear liner 42. As first chamfer 66A is drawn through J-groove 32 and across portions of wear liner 42, the sloped surface of first chamfer 66A acts to pull wear liner 42 into a fully seated position. For example, the sloped surface of first chamfer 66A acts as a wedge that exerts a gradual force onto wear liner 42 that draws wear liner 42 further into J-groove 32 and into a fully seated (i.e., fully installed) position within J-groove 32.

If wear liner 42 is not placed into J-groove 32 perfectly straight then wear liner 42 can get stuck at a slight diagonal preventing wear liner 42 from being fully seated within J-groove 32. When wear liner 42 gets stuck, the installation of vanes 34 into fan case 30 can be prohibited. Prior to tool 46, mechanics would place force on an outer part of wear liner 42 to force wear liner 42 to the bottom of J-groove 32 thereby risking damage to wear liner 42. If wear liner 42 becomes damaged, wear liner 42 can crack and parts of wear liner 42 can become ingested by gas turbine engine 10. The use of tool 46 allows for installation of wear liner 42 without applying abrupt or blunt forces directly to wear liner 42 which minimizes the risk of damage to wear liner 42. The pulling motion that tool 46 applies to wear liner 42 in order to pull wear liner 42 into J-groove 32 eliminates the need for the user to apply a force directly onto wear liner 42 that would push wear liner 42 in downward direction into J-groove 32.

Figure 4A:
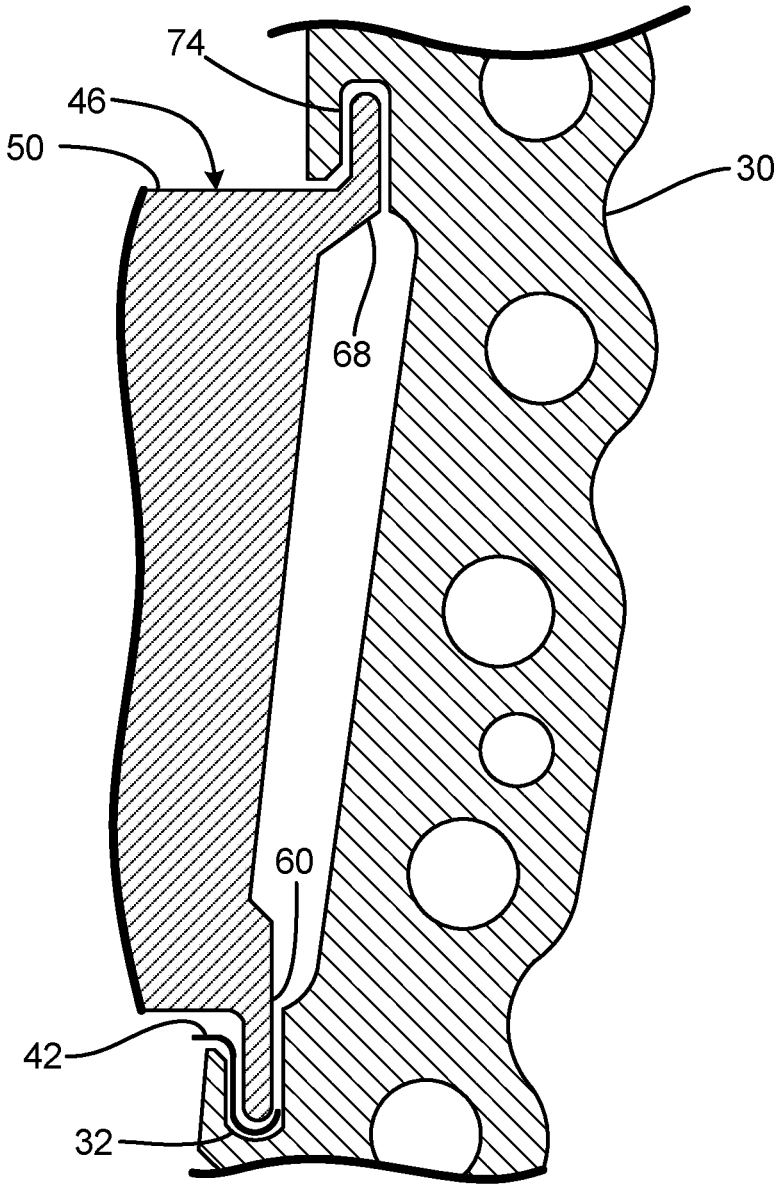
FIG. 4A is a cross section view of the tool inserted into the J-groove of the fan case.

FIG. 4A is a cross section view of tool 46 inserted into J-groove 32 and shows fan case 30 (with J-groove 32 and second groove 74), wear liner 42, tool 46, body 50, first guide foot 60, and second guide foot 68. Second groove 74 is a slot or groove set into and extending circumferentially within fan case 30. Wear liner 42 is disposed between first guide foot 60 and surfaces of J-groove 32. In this non-limiting embodiment, FIG. 4A shows wear liner 42 as being fully seated within J-groove 32 such that there are no gaps or spaces between the surfaces of wear liner 42 and the surfaces of J-groove 32. In other words, wear liner 42 cannot be pushed further into J-groove 32 because wear liner 42 is fully seated into J-groove 32 and in a position desirable to allow installation of vanes 34 into J-groove 32. During use of tool 46 with fan case 30, first guide foot 60 and second guide foot 68 are inserted into J-groove 32 and second groove 74, respectively.

First guide foot 60 includes a rounded edge so as to match a contour of a portion of the surface of wear liner 42 (as well as a contour of J-groove 32). Second groove 74 receives second guide foot 68. A cross-sectional shape of second guide foot 68 matches a cross-section shape or contour of second groove 74. Tool 46 is disposed relative to fan case 30 such that first guide foot 60 is inserted into J-groove 32 and second guide foot 68 is inserted into second groove 74.

Figure 4B:
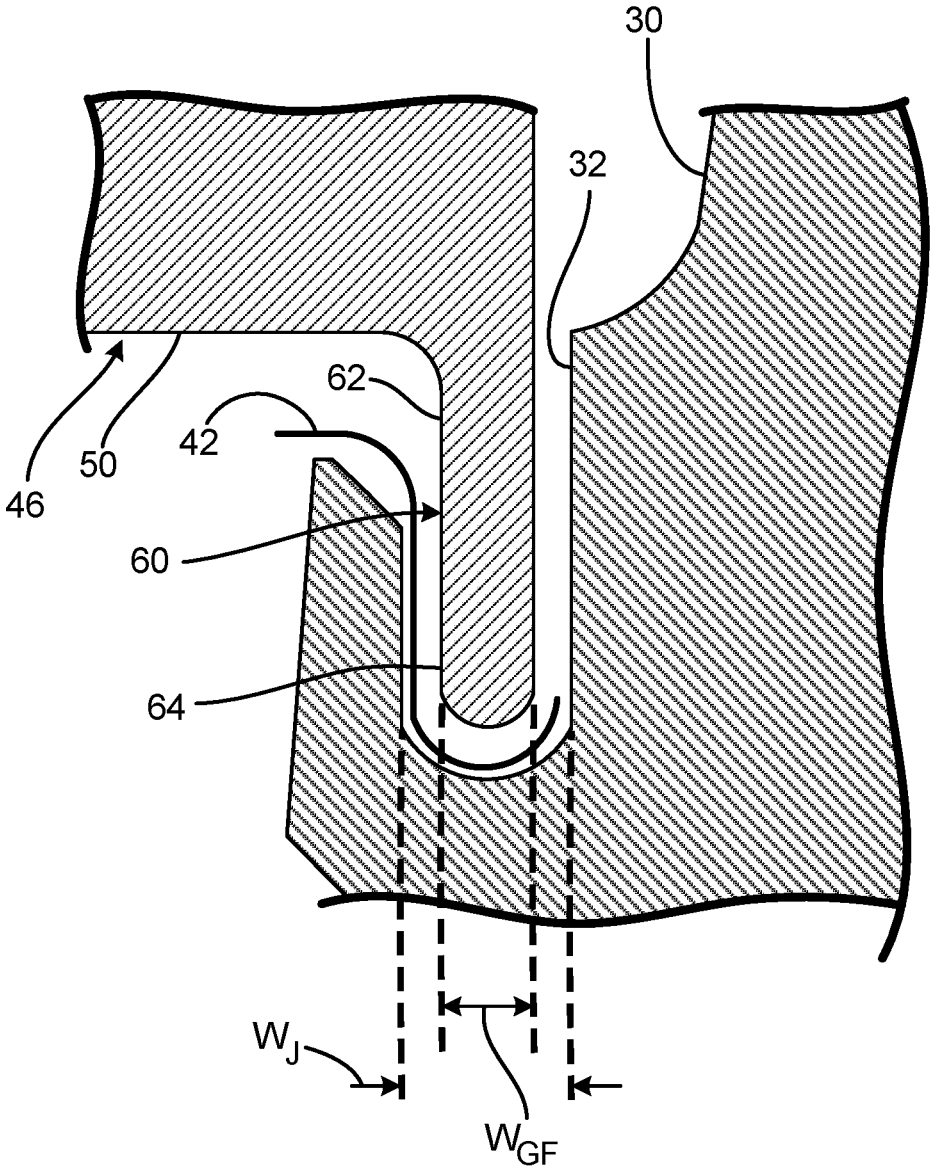
FIG. 4B is an enlarged cross section view of a portion of the tool inserted into the J-groove of the fan case.

The rounded edge of first guide foot 60 enables tool 46 to slide through J-groove 32 without catching on wear liner 42 or on portions of J-groove 32. If tool 46 were to have a sharp corner along an edge of first guide foot 60, such a corner would have the risk of catching on wear liner 42 and causing damage, in addition to potentially catching on a surface of J-groove 32 and getting stuck. Having second guide foot 68 inserted into and sliding through second groove 74 provides additional guidance for tool 46 and assists first guide foot 60 so as to maintain proper alignment with J-groove 32 as first guide foot 60 is slid through J-groove 32 and across wear liner 42. Having second guide foot 68 inserted into and sliding through second groove 74 also ensures that first guide foot 60 is fully inserted into J-groove 32 so that as first guide foot 60 is moved through J-groove 32, first guide foot 60 draws wear liner 42 into a completely seated position, such as shown in FIGS. 4A and 4B.

In one non-limiting embodiment, a method of installing wear liner 42 into J-groove 32 of fan case 30 includes aligning a portion of wear liner 42 with J-groove 32 of fan case 30. A portion of wear liner 42 is inserted into J-groove 32 of fan case 30. Whether wear liner 42 is stuck in J-groove 32 during insertion of wear liner 42 into J-groove 32 of fan case 30 is then detected by visual inspection by a user.

If wear liner 42 becomes stuck in J-groove 32, tool 46 is engaged with fan case 30 such that first guide foot 60 of tool 46 is inserted into J-groove 32 of fan case 30 and a portion of wear liner 42 is disposed between first guide foot 60 and a surface of J-groove 32 of fan case 30. Second guide foot 68 of tool 46 can be inserted into second groove 74 of fan case 30. Tool 46 is moved in a circumferential direction relative to fan case 30. Moving tool 46 in a circumferential direction relative to fan case 30 can include sliding first guide foot 60 of tool 46 through 180 degrees of the split case. Second guide foot 68 of tool 46 can also be slid through fan case 30 as tool 46 is moved in the circumferential direction relative to fan case 30.

First guide foot 60 of tool 46 is engaged with wear liner 42 such that first guide foot 60 pulls wear liner 42 into J-groove 32. Engaging first guide foot 60 of tool 46 with wear liner 42 includes drawing first chamfer 66A of first guide foot 60 in to contact with and across wear liner 42 and pulling wear liner 42 with first chamfer 66A of first guide foot 60 into a fully seated position within J-groove 32. Wear liner 42 is dislodged from a partially installed position and is pulled into J-groove 32 such that wear liner 42 is fully seated into J-groove 32. Seating wear liner 42 into J-groove 32 can include bringing all major faces of wear liner 42 into contact with surfaces of J-groove 32 of fan case 30. A plurality of vanes 34 can then be installed into J-groove 32 of fan case 30.

Using tool 46 to dislodge and install wear liner completely within J-groove 32 allows for vanes 34 to be installed into fan case 30 without getting caught on wear liner 42. If wear liner 42 is stuck in a position that is not fully seated within J-groove 32, the feet (e.g., aft feet 44) of vanes 34 can catch on wear liner 42 preventing some or all of vanes 34 from being correctly installed into fan case 30.

FIG. 4B is an enlarged cross section view of a portion of tool 46 inserted into J-groove 32 and shows fan case 30, J-groove 32 (with width $W_J$), wear liner 42, tool 46, body 50, first guide foot 60 (with width $W_{GF}$), first end 62 of first guide foot 60, and second end 64 of first guide foot 60.

Width $W_J$ is a width of J-groove 32. In the embodiment of FIG. 4A and 4B, width $W_J$ is the width of J-groove 32 in an axial direction as related to fan case 30 of gas turbine engine 10. Width $W_{GF}$ is a width of first guide foot 60. Width $W_J$ of J-groove 32 is greater than width $W_{GF}$ of first guide foot 60. Width $W_{GF}$ of first guide foot 60 is less than width $W_J$ of J-groove 32. With width $W_J$ of J-groove 32 being greater than width $W_{GF}$ of first guide foot 60, first guide foot 60 is able to slide through J-groove 32 without getting caught on the surfaces of J-groove 32. First guide foot 60 and second guide foot 68 of tool 46 have a looser fit within J-groove 32 than the feet (e.g., aft foot 44) of vanes 34 to allow tool 46 to circumferentially slide more easily through J-groove 32.

Figure 5A:
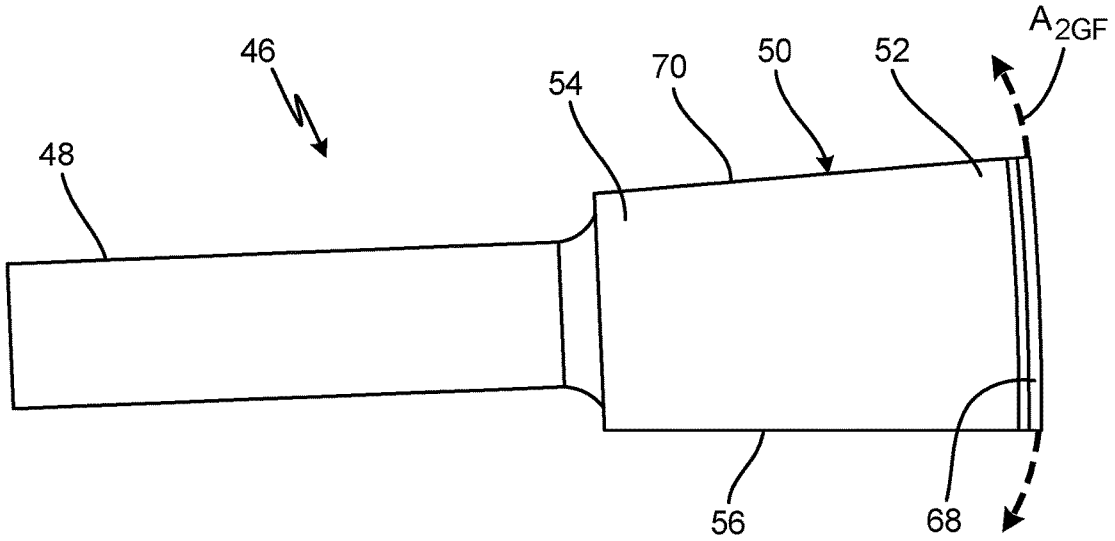
FIG. 5A is a top view of the tool.

FIG. 5A is a top view of installation tool 46 and shows tool 46, handle 48, body 50, first end 52 of body 50, second end 54 of body 50, first side 56 of body 50, second side 70 of body 50, second guide foot 68, and arc $A_{2GF}$ of second guide foot 68.

Arc $A_{2GF}$ is representative of the amount of curvature of second guide foot 68. In this non-limiting embodiment, arc $A_{2GF}$ of second guide foot 68 matches and/or corresponds with a curvature of second groove 74 in a circumferential direction of fan case 30. In another non-limiting embodiment, first guide foot 60 includes an arc with a curvature that matches and/or corresponds with a curvature of J-groove 32 in a circumferential direction of fan case 30. With arc $A_{2GF}$ of second guide foot 68 and the arc of first guide foot 60 matching and/or corresponding with second groove 74 and J-groove 32, respectively, tool 46 remains in circumferential and radial alignment relative to J-groove 32 and second groove 74 as tool 46 is moved along the circumference of fan case 30.

Figure 5B:
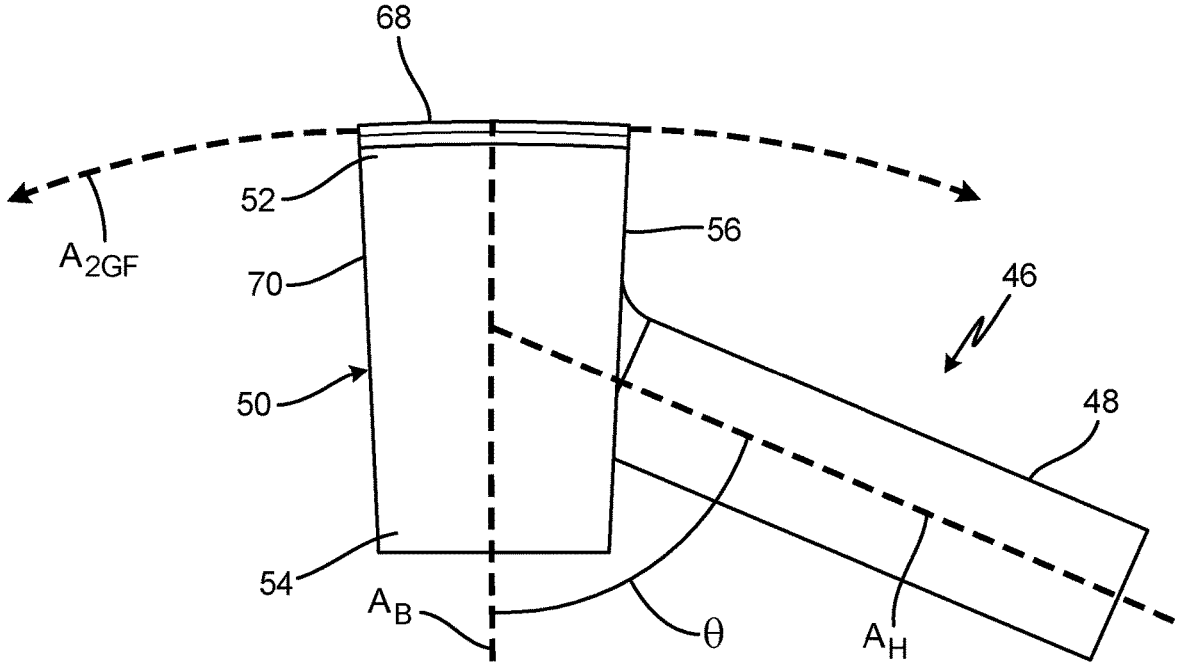
FIG. 5B is a top view of the tool with a handle at an angle.

FIG. 5B is a top view of tool 46 with handle 48 set at angle θ and shows tool 46, handle 48 (with longitudinal axis $A_H$), body 50 (with longitudinal axis $A_B$), first end 52 of body 50, second end 54 of body 50, first side 56 of body 50, second side 70 of body 50, second guide foot 68, arc $A_{2GF}$ of second guide foot 68, and angle θ. Longitudinal axis $A_H$ is an axis extending along a longitudinal direction of handle 48 of tool 46. Longitudinal axis $A_B$ is an axis extending along a longitudinal direction of body 50 of tool 46. In this non-limiting embodiment, the longitudinal direction of body 50 extends along a dimension of body 50 that is the greatest (i.e., longest) of each of the three Cartesian dimensions represented by the rectangular cuboid shape of body 50. Angle θ is an angle between longitudinal axis $A_H$ of handle 48 and longitudinal axis $A_B$ of body 50.

In this non-limiting embodiment, handle 48 is attached to body 50 on first side 56 of body 50. Longitudinal axis $A_H$ of handle 48 is oriented relative to longitudinal axis $A_B$ of body 50 at angle θ. In this non-limiting embodiment, angle θ is greater than zero degrees and less than 90 degrees. In another non-limiting embodiment, angle θ includes an amount of degrees that prevents handle 48 from coming into contact with wear liner 42 or fan case 30 as either first guide foot 60 or second guide foot 68 are inserted into J-groove 32 and second groove 74, respectively as well as during when tool 46 is moved along the circumference of fan case 30 during seating of wear liner 42 into J-groove 32. In one non-limiting embodiment, longitudinal axis $A_B$ of body 50 is oriented perpendicular to a tangent line of fan case 30 (not shown in FIG. 5B) at a point where longitudinal axis $A_B$ of body 50 would intersect fan case 30 when tool 46 is engaged with fan case 30 (e.g., second guide foot 68 is inserted into second groove 74 and/or first guide foot 60 is inserted into J-groove 32).

Angle θ being greater than zero is helpful in directing tool 46 around the circumference of J-groove 32 by way of orienting a force applied to tool 46 via handle 48 to be more parallel with a tangent line of J-groove 32 than if handle 48 were configured as in FIG. 5A. In this non-limiting embodiment, FIG. 5B provides a representation of an alternate connection point of handle 48 (e.g., on first side 56) so as to apply the driving force at a location closer to first and second guide feet 60 and 68 while also keeping handle 48 far enough away from first and second guide feet 60 and 68 so as not to interfere with J-groove 32 or wear liner 42.

Discussion of Possible Embodiments

The following are non-exclusive descriptions of possible embodiments of the present invention.

A tool for seating a wear liner into a first groove of a fan case of a gas turbine engine includes a body, a handle, and a first guide foot. The body includes a first end and a second end. The handle is connected to and extends from the body. The first guide foot is connected to and extends from the first end of the body. The first guide foot includes a first end connected to the body and a second end opposite from the first end of the first guide foot. The second end of the first guide foot is rounded and includes a chamfered portion.

The tool of the preceding paragraph can optionally include, additionally and/or alternatively, any one or more of the following features, configurations and/or additional components.

A first face can extend along a first side of the body, and/or a second face can extend along a second side of the body, wherein the second face can be on an opposite side of the body from the first face, wherein the first and/or second faces can be flat.

The first guide foot can comprise a curvature that can be configured to match a curvature of the first groove of the fan case.

A second guide foot can connect to and/or extend from the first end of the body, wherein the second guide foot can extend from the first end of the body in a direction that can be opposite from a direction that the first guide foot extends from the first end of the body, wherein the second guide foot can be configured to insert into a second groove of the fan case.

The first guide foot can include a first thickness, wherein the first thickness of the first guide foot can be less than a width of the first groove of the fan case.

A method of installing a liner into a first groove of a fan case of a gas turbine engine includes aligning a portion of the liner with the first groove of the fan case. A portion of the liner is inserted into the first groove of the fan case. A first guide foot of a tool is inserted into the first groove of the fan case such that a portion of the liner is disposed between the first guide foot and a surface of the first groove of the fan case. The tool is moved in a circumferential direction relative to the fan case. The first guide foot of the tool is engaged with the liner such that the first guide foot pulls the liner into the first groove. The liner is fully seated into the first groove.

The method of the preceding paragraph can optionally include, additionally and/or alternatively, any one or more of the following steps, features, configurations and/or additional components.

The fan case can include a split case that can be one half of a full fan case, wherein moving the tool in a circumferential direction relative to the fan case can further comprise sliding the first guide foot of the tool through 180 degrees of the split case.

All major faces of the liner can be brought into contact with surfaces of the first groove of the fan case.

A second guide foot of the tool can be inserted into a second groove of the fan case, and/or the second guide foot of the tool can be slid through the fan case as the tool is moved in the circumferential direction relative to the fan case.

A plurality of vanes can be installed into the first groove.

A chamfered portion of the first guide foot can be drawn in to contact with and/or across the liner, and/or the liner can be pulled with the chamfered portion of the first guide foot into a fully seated position within the first groove.

The liner can be dislodged from a partially installed position.

Whether the liner is stuck in the first groove during insertion of the liner into the first groove of the fan case can be detected.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A tool for seating a wear liner into a first groove of a fan case of a gas turbine engine, the tool comprising:

a body with a first end and a second end, the first end and second end defining a longitudinal body axis;

a handle connected to and extending from the body; and a first guide foot connected to and extending from the first end of the body, the first guide foot having a first end connected to the body and a second end extending radially away, with respect to the longitudinal body axis, from the first end of the first guide foot;

wherein the second end of the first guide foot is defined by parallel, opposing first and second sides; and wherein the second end of the first guide foot has a rounded edge at a radially outermost extent that is rounded along an axial cross-section, with respect to the longitudinal body axis.

2. The tool of claim 1, further comprising:

a first face extending along a first side of the body; and a second face extending along a second side of the body, wherein the second face is on an opposite side of the body from the first face, wherein the first and second faces are flat.

3. The tool of claim 1, wherein a shape of the rounded edge of the second end of the first guide foot through the axial cross-section follows a first curvature that is configured to match a curvature of the first groove of the fan case.

4. The tool of claim 3, wherein a longitudinal handle axis is perpendicular to the first curvature of the first guide foot.

5. The tool of claim 1, further comprising:

a second guide foot connected to and extending from the first end of the body in a radial direction opposite that of the first guide foot;

wherein the second guide foot is configured to insert into a second groove of the fan case.

6. The tool of claim 5, wherein:

the first guide foot extends along a first plane;

the second guide foot extends along a second plane; and the first plane and the second plane are parallel and nonidentical.

7. The tool of claim 1, wherein the first guide foot includes a first thickness, wherein the first thickness of the first guide foot is less than a width of the first groove of the fan case.

* * * * *